US008651085B2

(12) United States Patent
Hofbauer

(10) Patent No.: US 8,651,085 B2
(45) Date of Patent: Feb. 18, 2014

(54) PISTON-PIN BEARING LUBRICATION SYSTEM AND METHOD FOR A TWO-STROKE INTERNAL COMBUSTION ENGINE

(75) Inventor: Peter Hofbauer, West Bloomfield, MI (US)

(73) Assignee: Advanced Propulsion Technologies, Inc., Goleta, CA (US)

( * ) Notice: Subject to any disclaimer, the term of this patent is extended or adjusted under 35 U.S.C. 154(b) by 1163 days.

(21) Appl. No.: 12/583,913

(22) Filed: Aug. 27, 2009

(65) Prior Publication Data

US 2010/0224162 A1 Sep. 9, 2010

Related U.S. Application Data

(62) Division of application No. 11/818,660, filed on Jun. 14, 2007, now abandoned.

(60) Provisional application No. 60/832,646, filed on Jul. 21, 2006.

(51) Int. Cl.

| | |
|---|---|
| ***F01M 1/02*** | (2006.01) |
| ***F01M 1/06*** | (2006.01) |
| ***F04B 19/22*** | (2006.01) |

(52) U.S. Cl.

CPC . *F01M 1/02* (2013.01); *F01M 1/06* (2013.01); *F04B 19/22* (2013.01)

USPC ..... 123/196 R; 417/211

(58) Field of Classification Search

CPC ..... F04F 7/00; F04F 7/02; F04B 19/003; F04B 19/02; F04B 19/022; F04B 19/22; F04C 9/00; F04C 9/002; F04C 9/005; F04C 9/007

USPC ..... 123/196 R, 198 C, 41.37; 417/211, 240, 417/241; 184/24

See application file for complete search history.

(56) References Cited

U.S. PATENT DOCUMENTS

| | | | | |
|---|---|---|---|---|
| 2,843,221 | A | 7/1958 | Haring | |
| 3,131,785 | A * | 5/1964 | Blank | 184/6 |
| 5,724,863 | A | 3/1998 | Kramer | |
| 6,170,443 | B1 | 1/2001 | Hofbauer | |

* cited by examiner

*Primary Examiner* — Lindsay Low
*Assistant Examiner* — Jacob Amick

(57) ABSTRACT

An improved lubrication system and method for the normally contacting and abutting piston pin and connecting rod journal bearing surfaces of an internal combustion engine that includes an inertia pump in a connecting rod. The inertia pump reacts to the movement of the connecting rod and conveys a predetermined measure of lubricating oil at a high enough pressure to overcome the forces which cause the surfaces to normally maintain contact. By separating the normally contacting surfaces of the pin and the connecting rod journal, the surfaces become lubricated. Several embodiments of inertia pumps provide variations in implementing the invention.

16 Claims, 9 Drawing Sheets

203
204
203

206
209
202
213
204
201
203
203
2B
2B
205

210
207
214
208
212
216
200
304
303
303

306
312
307
314
310
308
303
304
2D
2D 303
301
305
302
316
309
300

PISTON-PIN BEARING LUBRICATION SYSTEM AND METHOD FOR A TWO-STROKE INTERNAL COMBUSTION ENGINE

RELATED APPLICATIONS

This application claims the benefit of U.S. provisional application Ser. No. 60/832,646 filed Jul. 21, 2006 and is a divisional of non-provisional application Ser. No. 11/818,660 filed Jun. 14, 2007 now abandoned.

TECHNICAL FIELD

This invention is related to the field of internal combustion engines and more specifically to a lubrication system and method that supplies lubricating oil to the piston-pin bearings of two-cycle engines.

BACKGROUND

Some conventional internal combustion engines are configured to provide lubricating oil to piston-pin bearings by pumping the oil into the small gap surrounding much of the circumference of the pin. However because of the way two-cycle engines operate, one portion of the pin is in constant contact with the journal surface of the connecting rod during the entire stroke of the engine. That portion is difficult to lubricate and is subject to wear.

In some two-cycle engines, such as the Internal Combustion Engine With A Single Crankshaft And Having Opposing Cylinders And Opposing Pistons In Each Cylinder ("OPOC engine") described in my U.S. Pat. No. 6,170,443 and incorporated herein by reference, lubricating oil is pumped through passages in the crankshaft and connecting rods to the piston pins.

There is a need to improve the piston-pin lubrication system as it applies to two-cycle engines, since available oil pressure in conventional engines does not overcome the combustion gas forces and inertia forces that act on the piston-pins during the entire stroke in the direction towards the crankshaft to provide effective lubrication. Without sufficient lubrication, excess heat and frictional wear may result.

SUMMARY

The present invention provides several improvements to the piston-pin lubricating system of two-cycle engines. Several embodiments are shown which utilize an inertia pump in a connecting rod to overcome the forces and inject the proper amount of oil between the normally abutting bearing surfaces of the piston-pin and connecting rod journal.

The use of inertia pumps in the embodiments takes advantage of the changing speeds of the pistons and connecting rods that occur during each stroke of the engine. The acceleration and deceleration forces cause the plunger mass within each the inertia pump to react and cause the pump to become charged with lubricating oil as it approaches its top dead center ("TDC") position and then to inject a predetermined amount of oil under high pressure between the surfaces of the piston pin and the connecting rod journal as it approaches bottom dead center ("BDC") position. The timing of the injection near BDC is selected because the gas forces present on the piston are at their minimum and only the inertia forces on the piston have to be overcome by the output of the inertia pump. This causes a sufficient separation between the surfaces to allow a predetermined charge of lubricating oil to flow there-between.

In a first embodiment of an inertia pump, a single check valve is employed along with an inertia driven plunger. The check valve becomes open and allows oil to flow from an external pressure source (the engine oil pump) into the pumping chamber and out of the inertia pump into the piston pin bearing during the time when the piston decelerates while approaching its TDC in the later part of the compression stroke and also when the piston accelerates during the early portion of the expansion stroke following TDC.

As the piston passes through its mid-compression stroke and mid-expansion stroke the inertia forces become minimal and the angles of the connecting rods with respect to the piston pins are at their extremes. During these strokes the check valve opens and oil from the external pressure source flows through the inertia pump and into grooves formed in the piston pin and journal.

In reaction to the inertia caused movement of the pump plunger mass and the check valve mass as the piston decelerates during the later portion of the expansion stroke as it approaches BDC and during the acceleration that occurs during the early portion of the compression stroke immediately following BDC, the check valve closes and the pump plunger forces oil out of the inertia pump under high pressure. The closed check valve prevents the oil pumped by the pump plunger from flowing back to the pressure source while the inertia pump forces oil into the piston pin bearing under a high pressure that is greater than the inertia pressure holding the bearing surfaces together. This results in a brief separation of the surfaces and their lubrication.

In a second embodiment, the check valve is replaced with a freely sliding inertia mass valve that moves independent of the inertia driven pump plunger. In this embodiment, the operation is similar to the first embodiment. However, the inertia valve is subject to the inertia induced motion in the valve chamber independent of the same inertia forces that subject the pump plunger to move within the pump chamber. By being independently subject to the same inertia forces that are applied to the plunger, the inertia valve can be selected to react earlier or later than the plunger during the stroke to prolong or earlier terminate the flow of oil from the source through the inertia pump. One result of earlier termination would be for the plunger to inject more oil into the space forced open between the bearing surfaces.

It is an object of the present invention to provide an improved lubricating system and method for a two-cycle engine by providing an inertia pump within a connecting rod to supplement the flow of lubricating oil into the associated piston pin by forcibly injecting a predetermined amount of oil between the abutting piston pin and the connecting rod journal surfaces.

It is another object of the present invention to provide an improved lubricating system and method for a two-cycle engine by providing an oil pump that acts in response to deceleration and acceleration of the piston as it approaches and exits its BDC portion of the stroke to overcome the forces between the abutting piston pin and the connecting rod journal surfaces and injecting a predetermined amount of oil there-between.

It is a further object of the present invention to provide improved inertia pumps suitable for use within the moving components of an internal combustion engine.

DETAILED DESCRIPTION OF EXEMPLIFIED EMBODIMENTS

While the present invention is summarized above as being applicable for several types of internal combustion engines, it is exemplified herein as being installed in a two-cycle OPOC engine, such as that shown in my referenced patent.

Figure 1:
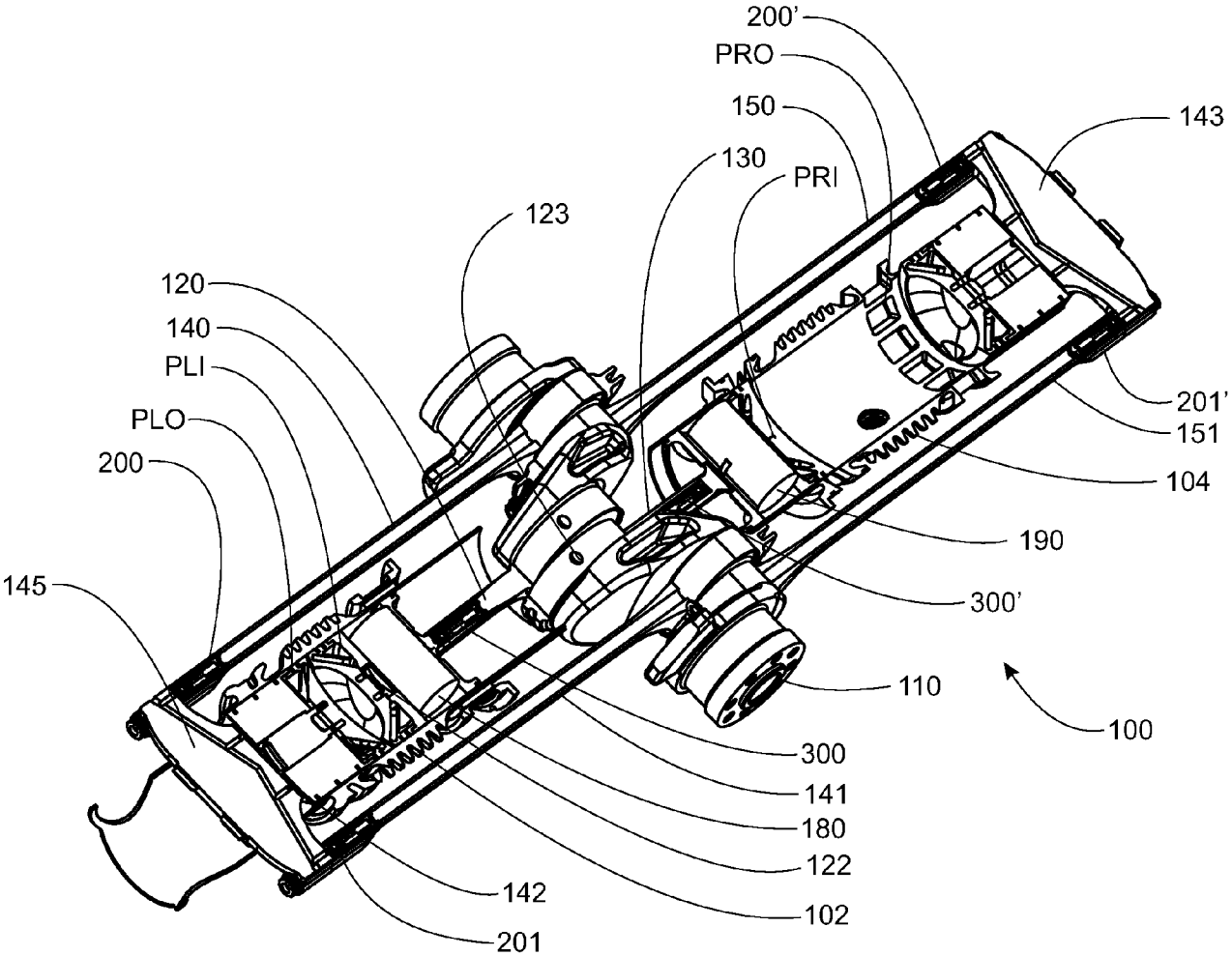
FIG. 1 is a cutaway drawing of a two-cycle OPOC engine showing the location of the embodiments of the present invention.
Figure 6:
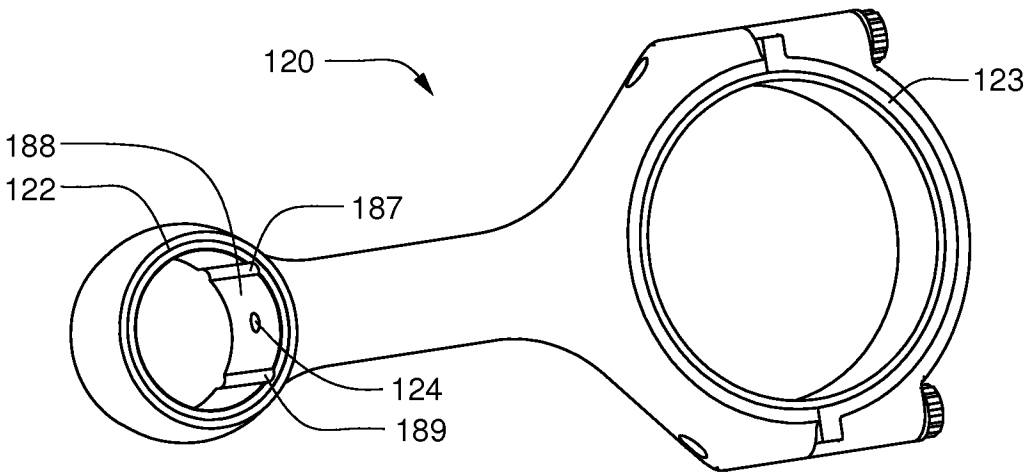
FIG. 6 is a perspective view of an inner piston connecting rod of an OPOC engine such as shown in FIG. 1.
Figure 7:
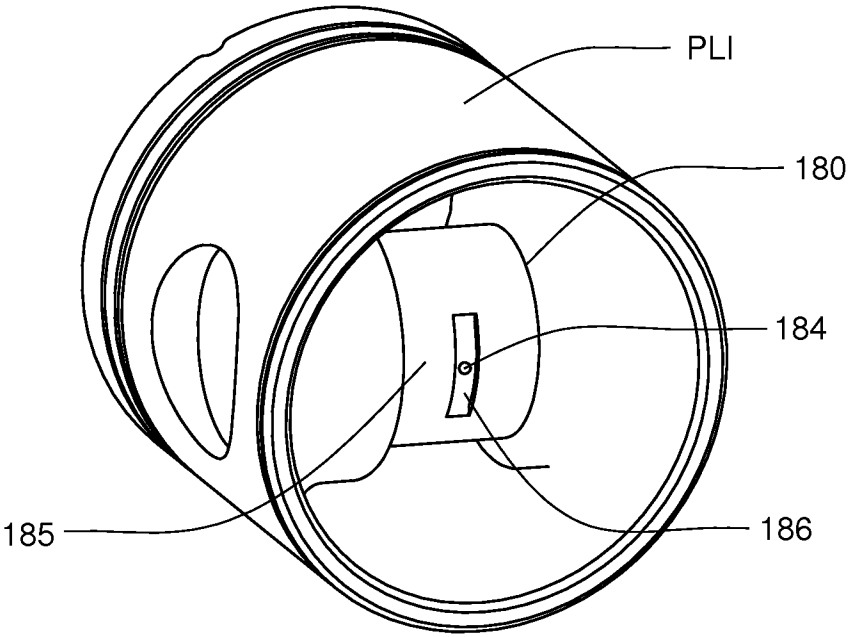
FIG. 7 is a perspective view of the underside of an inner piston and associated piston pin of an OPOC engine such as shown in FIG. 1 accommodated for use with the present invention.

In FIG. 1, opposing left cylinder 102 and right cylinder 104 of an OPOC engine 100 are shown in a cut-away view. Inner pistons PLI (left) and PRI (right) respectively oppose outer piston PLO (left) and PRO (right) within the corresponding cylinders 102 and 104. Inner connecting (push) rods 120 and 130 provide power connections between the inner pistons PLI and PRI and the crankshaft 110. Outer connecting (pull) rod sets 140, 141 and 150, 151 provide power connections between the outer pistons PLO and PRO and crankshaft 110. Each of the connecting rods has a "small" end which is connected to a piston pin. Piston pins 180 and 190 are associated with pistons PLI and PRI, while piston pins 142 and 143 are associated with pistons PLO and PRO. In FIG. 6 a detailed view of push rod 120 is shown, while in FIG. 8 a detailed view of pull rods 140 and 141 are shown.

In each connecting rod, an inertia pump is shown as installed to provide the lubrication to the piston pin as discussed above in the Summary of the Invention. Inertia pumps 200, 201, 300, 300', 200' and 201' are respectively installed in corresponding connecting rods 140, 141, 120, 130, 150 and 151. Each connecting rod has oil passages that function in a conventional way to convey lubricating oil from an oil pump through the crankshaft and connecting rods to the piston pins. However, by adding inertia pumps within the passages, it is possible to achieve the objects of the present invention.

Figures 2A, 2B, 2C, 2D:
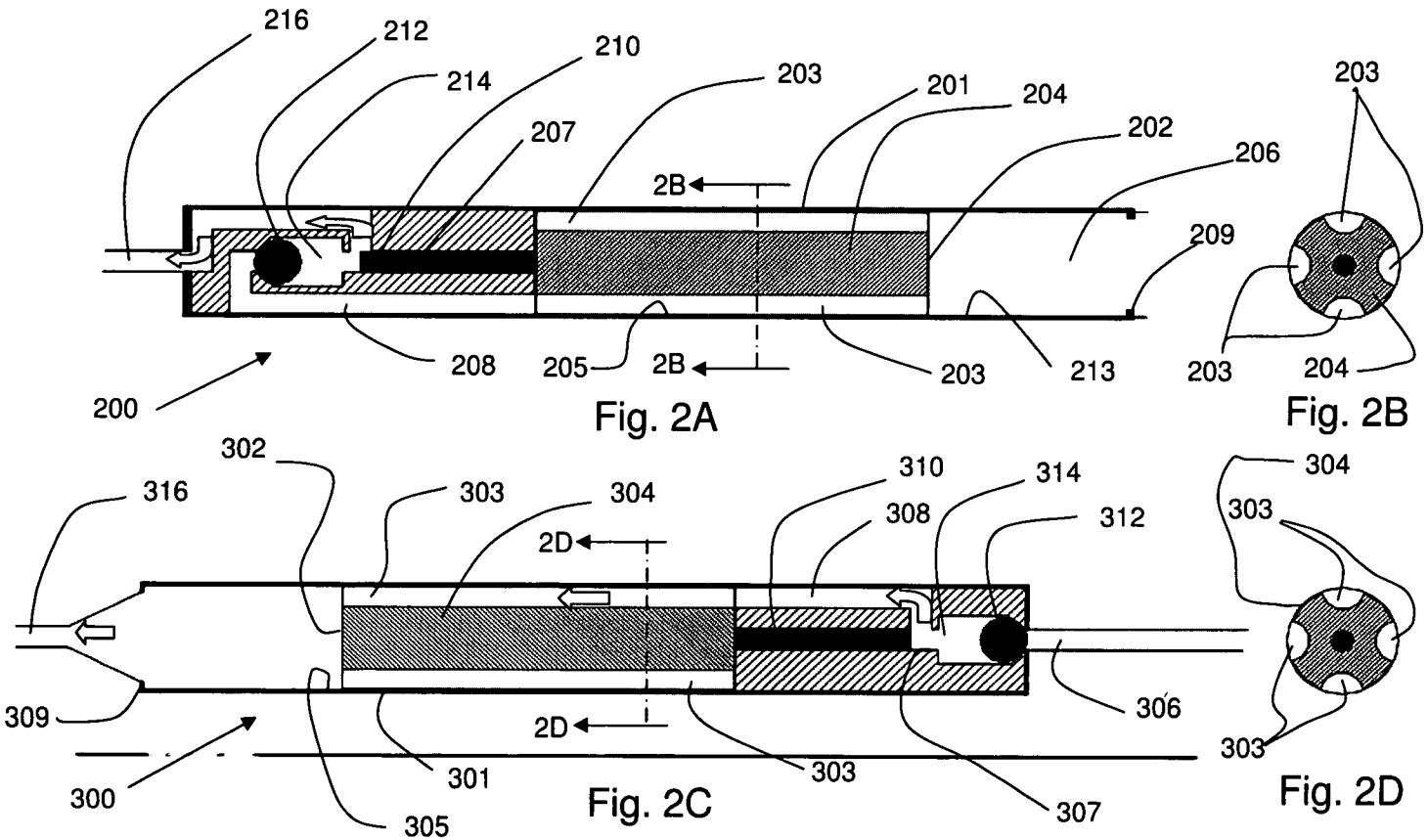
FIG. 2A is a cross-sectional view of a first embodiment of an inertia pump used in the inner piston connecting rods the OPOC engine shown in FIG. 1.
FIG. 2B is a cross-sectional view of the piston plunger of the inertia pump shown in FIG. 2A taken along section lines 2B-2B.
FIG. 2C is a cross-sectional view of a first embodiment of an inertia pump used in the outer piston connecting rods the OPOC engine shown in FIG. 1.
FIG. 2D is a cross-sectional view of the piston plunger of the inertia pump shown in FIG. 2C taken along section lines 2D-2D.
Figures 3A, 3B, 3C, 3D:
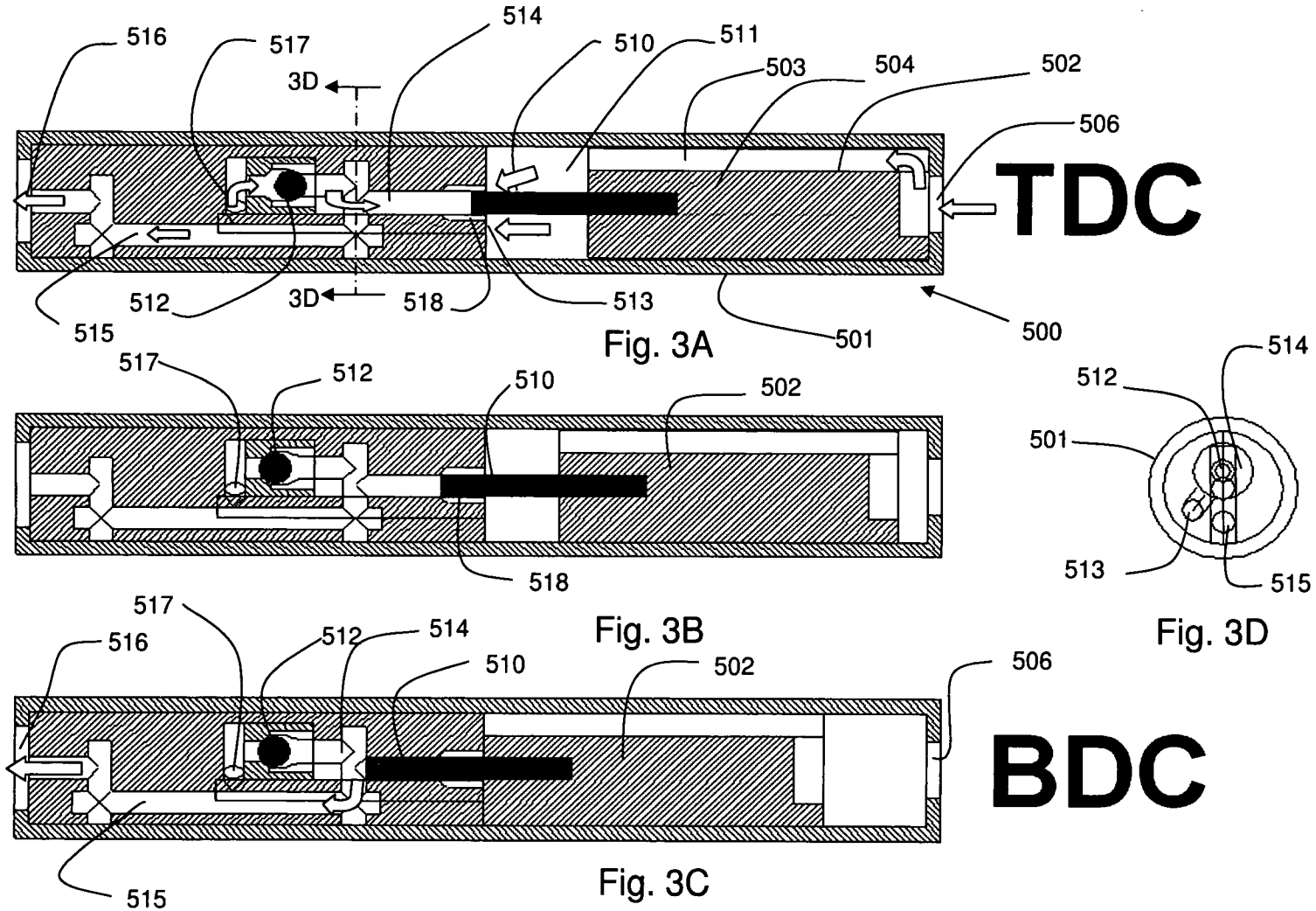
FIG. 3A is a cross-sectional view of a second embodiment of an inertia pump used in the connecting rods the OPOC engine shown in FIG. 1 near and at TDC of the stroke.
FIG. 3B is a cross-sectional view of the inertia pump shown in FIG. 3A at the mid-stroke position between TDC and BDC.
FIG. 3C is a cross-sectional view of the inertia pump shown in FIGS. 3A and 3B near and at BDC of the stroke.
FIG. 3D is a cross-sectional view of the pumping chamber taken along lines 3D-3D in FIG. 3A.

In FIGS. 2A and 2B, a first embodiment of an inertia pump 200, such as that shown installed in pull rod 140 in FIG. 1, is shown. Pump 200 has a housing 201 and is shown for use in association with a pull rod and outer left piston PLO. A plunger 202 is the core of the pump since it slides within a two stage bore in the pump housing 201 in reaction to deceleration and acceleration forces present in the pull rod over the stroke. The plunger 202 is defined to have a first cylindrical mass portion 204 with passages in the shape of grooves 203 formed along its length. The grooves 203 are sufficiently large to allow the plunger to be moved by inertia forces with little resistance by oil present in the housing and also to allow oil to pass through the pump from the entry port 206 to the outlet port 216 due to pressure maintained by the engine oil pump (not shown).

The two stage pump bore includes an oil supply section 205 and a plunger bore section 207. The plunger element 202 is also a two stage element that resides within the pump bore and its plunger mass portion 204 resides totally in bore section 213 and its plunger pump portion 210 extends from plunger mass portion 204 to move within plunger bore section 207. A stopper element 209 is located at one end of section 205 to limit movement of the plunger element therein. Stopper element 209 is adjacent an input port 206 through which oil enters inertia pump 200 from the lubricating passages in the connecting rod.

Figure 9:
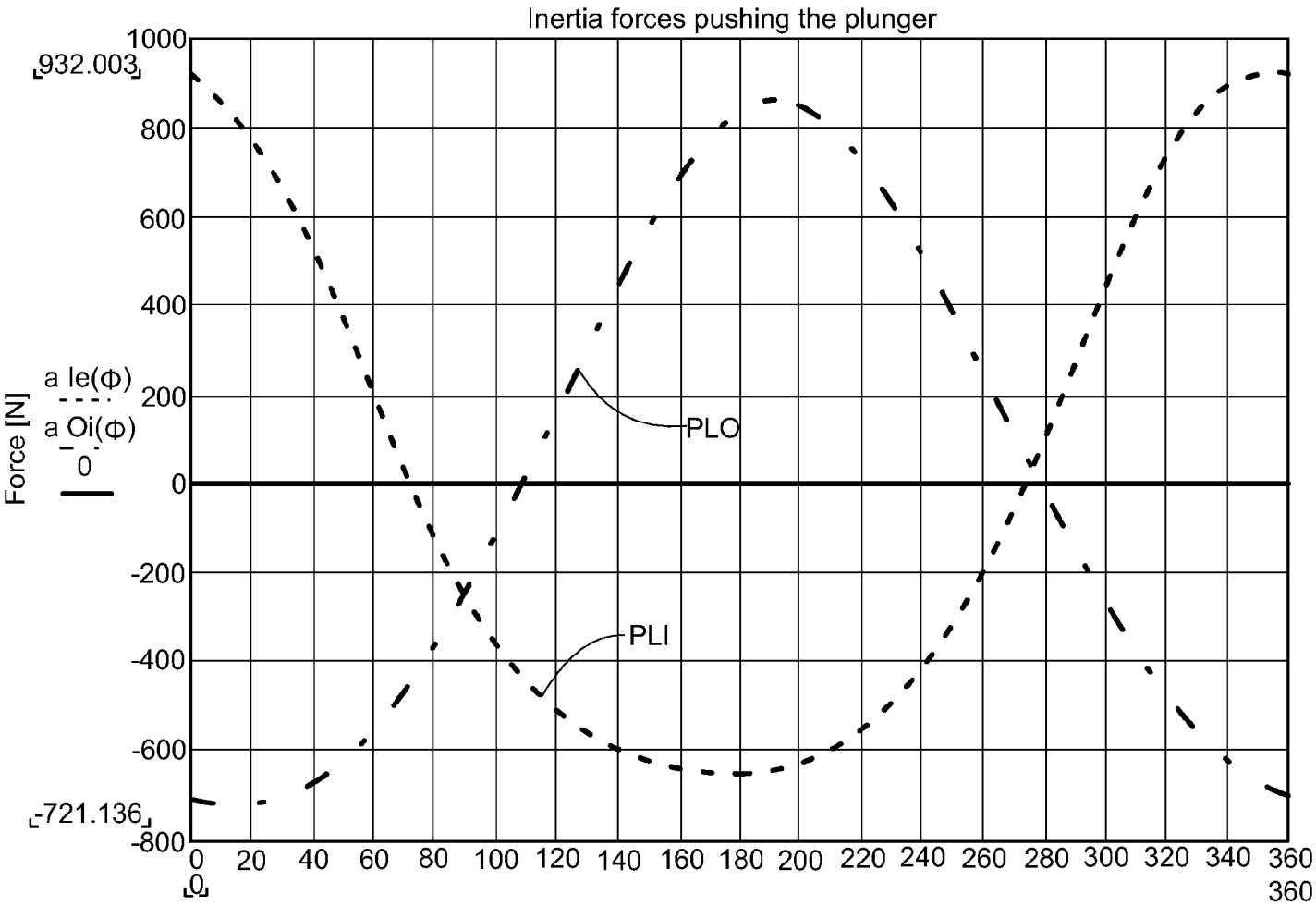
FIG. 9 is a chart that shows the plot the inertia forces present on an inertia pump plunger during a full stroke of the inner and outer pistons in an OPOC engine, such as shown in FIG. 1.

The embodiment of the inertia pump 200 shown in FIGS. 2A and 2B is exemplified as being in the final portion of its stroke towards BDC, at BDC, or in the early portion of the stroke following BDC. At this position the inertia forces continue to push the plunger element to its extreme left position, as the outer left piston PLO would be at BDC, and the oil has been expelled at a high pressure from the bore section 207 by the plunger pump portion 210. (See the plot of forces approaching and leaving 0 (360) degrees or BDC position in FIG. 9.)

A normally open check valve 212 is provided in the pump chamber 214. In the shown position, the pressure provided by the inertia pump and the inertia forces acting on the valve itself cause check valve 212 to close. This closing serves to concentrate the oil being pumped by the plunger pump portion 210 into outlet port 216 and into the piston pin bearing. When closed, check valve 212 also prevents back-flow into the oil supply passages in the connecting rod.

In other positions of the stroke, check valve 212 remains open and allows lubricating oil from the engine oil pump to provide oil in a conventional manner through the connecting rod and inertia pump 200 via input port 206, grooves 203, passage 208, check valve 212, chamber 214 and outlet port 216. Although such pressure is sufficient to effect lubrication of parts of the piston pin and journal surfaces, it is not sufficient to overcome the forces which cause the portions of the pin and piston journal surfaces to be held together.

In FIGS. 2C and 2D, an embodiment off an inertia pump 300 is shown to be suitable for installation in a push rod, such as 120 associated with left inner piston PLI. In that embodiment, the pump 300 has a housing 301 with an inlet port 306 and an outlet port 316. The pump embodiment shown in FIG. 2C is oriented opposite to the embodiment shown in FIG. 2A, since the inertia forces acting on those pumps approaching and leaving the BDC positions of their associated outer and inner pistons are opposite.

In FIG. 2C, a plunger 302 is also the core of the pump since it slides within a two stage bore in pump housing 301 in reaction to deceleration and acceleration forces present in the push rod over the stroke. The plunger 302 is defined to have a first cylindrical mass portion 304 with passages in the shape of grooves 303 formed along its length. The grooves 303 are sufficiently large to allow the plunger to be moved by inertia forces with little resistance by oil present in the housing and also to allow oil to pass through the pump from the entry port 306 to the outlet port 316 due to pressure maintained by the engine oil pump (not shown). The grooves 303 also provide a path for oil to flow under high pressure when it is pumped by plunger element 302.

The two stage pump bore includes a mass bore section 305 and a plunger bore section 307. Mass bore section 305 is also in communication with the outlet port 316. The plunger element 302 is also a two stage element that resides within the pump bore and its plunger mass portion 304 resides totally in mass bore section 305 and its plunger pump portion 310 extends from plunger mass portion 304 to move within plunger bore section 307. A stopper element 309 is located at one end of section 305 to limit movement of the plunger element therein. Stopper element 309 is adjacent a central outlet port opening 316 through which oil exits the inertia pump 300 to the piston pin bearing.

A normally open check valve 312 is provided in the pump chamber 314. In the shown position, the pressure provided by the inertia pump and the inertia forces acting on the valve itself cause check valve 312 to close. This closing serves to concentrate the oil being pumped by the plunger pump portion 310 through passage 308, plunger groove passages 303, outlet port 316 and into the piston pin bearing. When closed, check valve 312 also prevents back flow into the oil supply passages in the connecting rod.

In positions other than approaching and leaving BDC, the check valve 312 opens and allows lubrication oil from the lower pressure oil pump system to flow in a conventional manner through the inertia pump and into the bearing as discussed above.

Figures 4A, 4B, 4C, 4D:
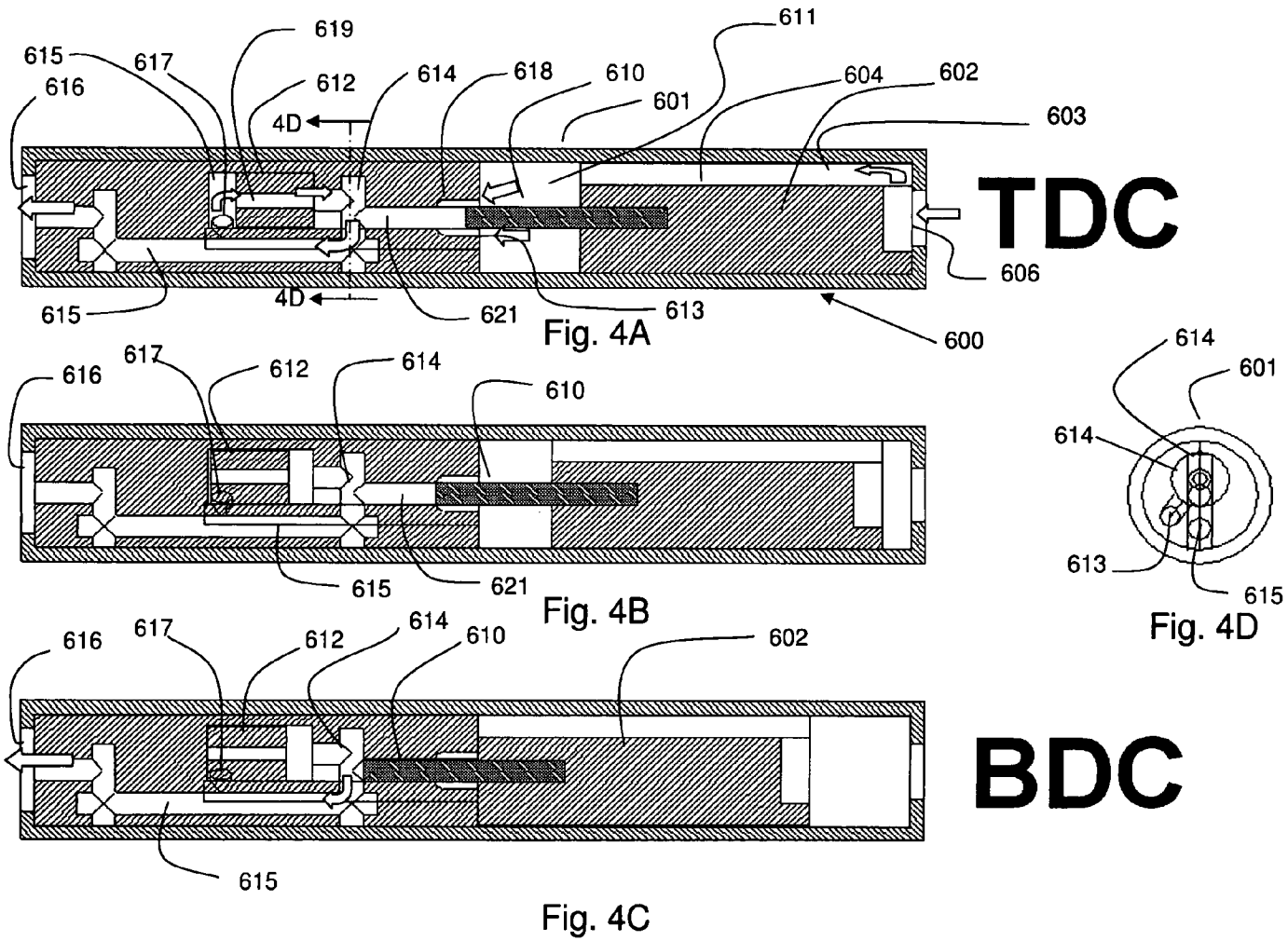
FIG. 4A is a cross-sectional view of a third embodiment of an inertia pump used in the connecting rods the OPOC engine shown in FIG. 1 near and at TDC of the stroke.
FIG. 4B is a cross-sectional view of the inertia pump shown in FIG. 4A at the mid-stroke position between TDC and BDC.
FIG. 4C is a cross-sectional view of the inertia pump shown in FIGS. 4A and 4B near and at BDC of the stroke.
FIG. 4D is a cross-sectional view of the pumping chamber taken along lines 4D-4D in FIG. 4A.

FIGS. 4A-4D illustrate yet another embodiment of an inertia pump 600 that can be utilized in the present invention. In this embodiment, the Figures illustrate the same inertia pump 600 in three different stages of its operation. In FIG. 4A, the associated piston is in the later part of its compression stroke approaching TDC, at TDC or beginning its expansion stroke following TDC. In this position, oil from the lubrication system pump is allowed to flow through inertia pump 600 and to the associated piston pin. Housing 601 has an oil entry port 606 and an outlet port 616. A two stage plunger element 602 has a plunger mass portion 604 and a pump plunger portion 610 that is similar to the other embodiments discussed above. As in the prior embodiment, the plunger mass portion 604 contains at least one plunger aperture or groove passage 603 that allows oil to freely flow from entry port 606 and into a pump bore 611 and reduces and resistance to the longitudinal movement of the plunger mass within pump bore 611.

A pump chamber 614 surrounds pump plunger 610 and contains a set of grooved openings 618 that allow oil to flow past pump plunger 610 when it is in the position shown in FIG. 4A.

A cylindrical mass 612 containing a central passage 619 freely moves within a bore 615 and replaces check valve 512 shown in the prior described embodiment. Cylindrical mass 612 is neither normally open nor normally closed, as spring loaded check valves are configured. Instead, cylindrical mass 612 is inertia driven, but independent from the plunger 602. In this configuration, cylindrical mass 612 can be configured by its size, its mass and its aperture resistance to open and close the supply opening 617 at precise positions in the stroke and thereby provide for increased timing of the oil flow from the conventional engine pump source while allowing the pump chamber 614 to become primed when plunger 610 is driven as it approaches BDC.

In FIG. 4A, supply opening 617 is open because inertia forces have caused cylindrical mass 612 to be located at the right side of bore 621. Oil from the conventional source, is pumped through inertia pump 600 via entry port 606, plunger aperture 603, chamber 611, groove passages 618, into bore 621, and oil passage 613, port 617 aperture 619, chamber 614, passage 615 and outlet port 616.

Passage 613 is indicated as ghost lines in FIGS. 4A, 4B and 4C. Passage 613 is better illustrated in FIG. 4D as being offset from the planar section provided for FIGS. 4A, 4B and 4C. Passage 613 provides communication flow of lubricating oil between plunger chamber 611 and pump chamber 614. In the position illustrated in FIG. 4A, the lubricating oil sourced under normal pressure from the engine oil pump passes through pump chamber 614, leaving it filled and primed, and into passage 615 to exit through outlet port 616.

In FIG. 4B, the inertia pump is shown at a later portion of the expansion stroke when inertia forces are starting to reverse and thereby causing the cylindrical mass 612 to be forced towards the left and closing port 617. Independently, plunger mass 602 is also forced towards the left and grooves 618 become blocked. With port 617 being closed by cylindrical as 612 and grooves 618 blocked by plunger mass 602 being forced towards the left, high pressure is being developed by the movement of plunger pump 610 in bore 621. This prevents conventionally pumped lubricating oil from flowing into the bearing while pressure is built up to overcome the forces which cause the bearing surfaces to be forced together.

In FIG. 4C, pump 600 is shown as having reached the later portion of the expansion stroke approaching BDC, at BDC, or in the beginning of the compression stroke following BDC. In these positions, the inertia forces present in pump 600 become high enough to cause the injection of a predetermined volume of lubrication oil between the piston pin and piston journal surfaces. Forces present at the output port 616 cause the piston pin and piston journal surfaces to be separated sufficiently to allow oil to flow therebetween.

With reference to FIGS. 5A, 5B, 5C, 6 and 7, the piston pin and connecting rod journal lubrication distribution system for a piston is shown. In the figures, piston pin 180 is mounted on an inner piston PLI and has a central surface which fit within a journal 188 at the small end of an inner piston connecting rod 120. In these drawings, the inertia pumps have not been indicated. However, the ghost lines of FIG. 6 indicate oil passages and a void were an inertia pump is located. The connecting rod 120 is constantly being driven by either its associated inner piston or the crankshaft and its small end is subject to oscillatory movement over the limited angles indicated beyond TDC and BDC.

Figure 5B:
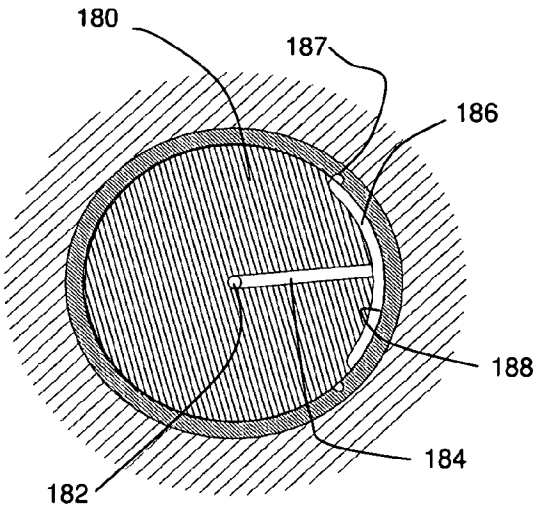
FIG. 5B is a cross-sectional view taken across the axis of the piston-pin shown in FIG. 5A rotated to one extreme during the stroke.
Figure 5C:
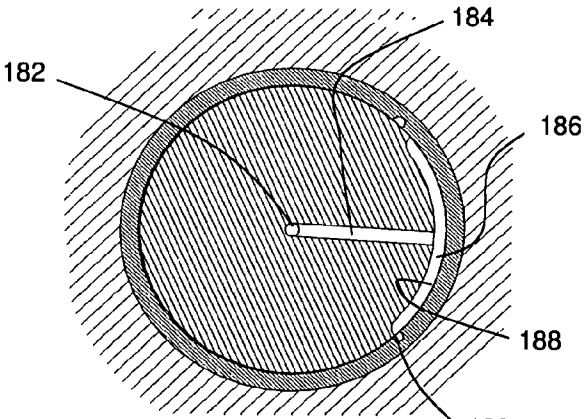
FIG. 5C is a cross-sectional view taken across the axis of the piston-pin shown in FIG. 5A rotated to its opposite extreme during the stroke.
Figure 5A:
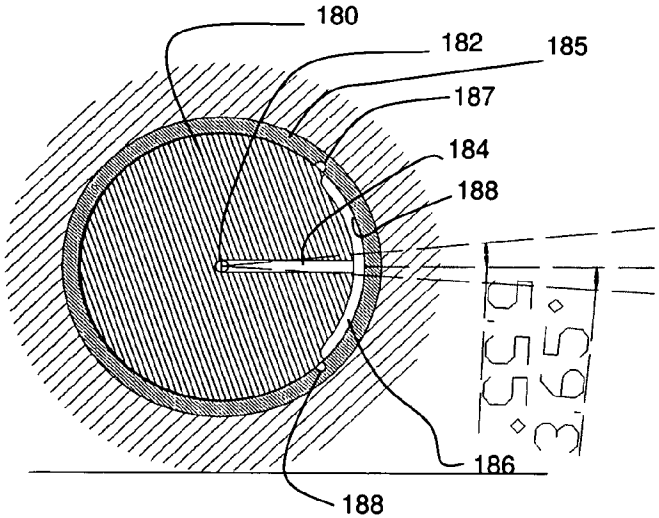
FIG. 5A is a cross-sectional view taken across the axis of a piston-pin within a piston journal when the piston is at its BDC position.

FIG. 5A illustrates the orientation of a piston pin at both its TDC and BDC positions. An axial oil passage 182 is formed in piston pin 180 and is in communication a radial passage 184. An arcing groove 186 is formed on the outer surface of the piston pin 180 and is aligned with the opening of radial passage 184. In the small end 122 of connecting rod 120 (FIG. 6), a journal is formed having a cylindrical surface 188 that is slightly larger in diameter than the piston pin 180. Spaced apart cross grooves 187 and 189 are formed in the journal surface. Oil passage 124, in communication with the outlet port of an inertial pump within the connecting rod, opens through the journal surface 188 and is in constant registration and alignment with arcing groove 186 in piston pin 10.

In operation in conjunction with the inertia pump, oil flows from the inertia pump when the piston is at BDC in FIG. 5A. The oil is injected at a high enough pressure to overcome the inertia pressures forcing the surfaces 185 and 188 together. The oil flows from passage 124 into arc groove 186 and spreads over the adjacent area of the abutting surfaces to provide lubrication.

When the engine cycles past BDC and the connecting rod approaches the extreme limit of its angle in a first direction, cross groove 187 becomes exposed to arc groove 186 and oil from the conventional lubrication pump flows into the cross groove. Lubricating oil is then spread over that portion of the abutting surfaces 188 and 185 that pass over cross groove 187.

Likewise, when the engine cycles past TDC and the connecting rod approaches the extreme limit of its angle in a second direction, cross groove 189 becomes exposed to arc groove 186 and oil from the conventional lubrication pump flows into cross groove 189. Lubricating oil is then spread over that portion of the abutting surfaces 188 and 185 that pass over cross groove 189.

Figure 8:
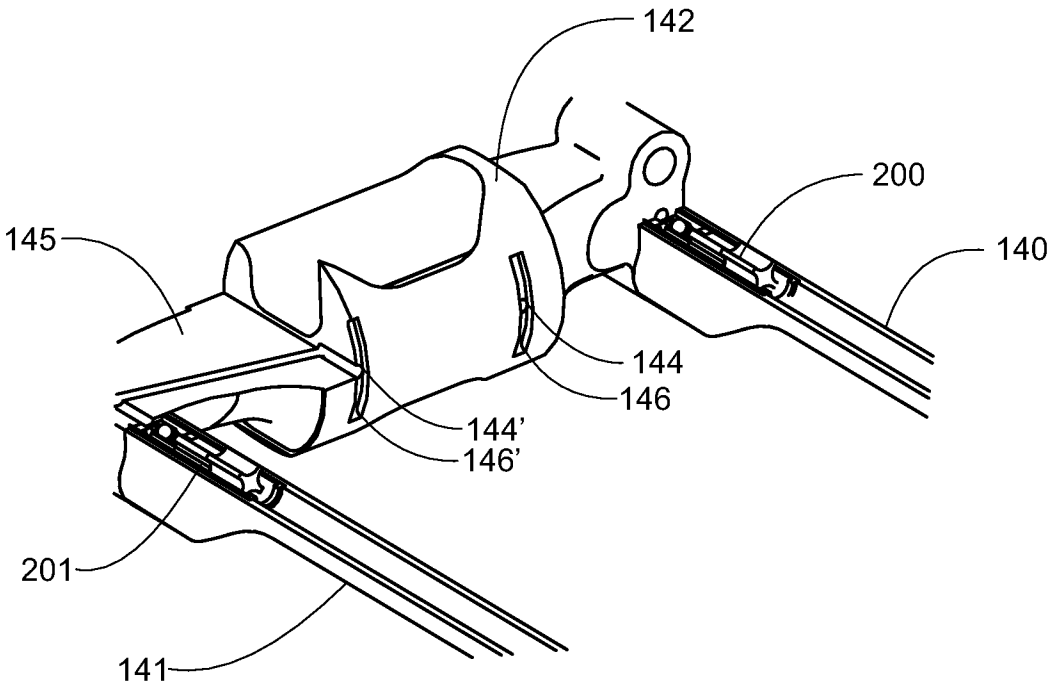
FIG. 8 is a perspective view of the present invention installed within the outer connecting rods of an OPOC engine such as shown in FIG. 1.

In FIG. 8, an outer piston pin and connecting rod assembly is shown wherein connecting rods 140 and 141 each contain inertia pumps 200 and 201. Connecting rods 140 and 141 are connected to a cross member 145 which supports an outer piston pin 142. In this case, the outer piston pin contains a pair of arc grooves 146 and 146'. Oil passages 144 and 144' are centrally located within each arc groove to provide the injected oil from the inertia pump and oil from a conventional oil pump identical in manner to that explained with respect to the inner piston pins above. That is, the journal of the outer piston (not shown) has spaced apart cross grooves to distribute oil when the inertia pump is not injecting lubricating oil between the abutting bearing surfaces.

From the foregoing, it can be seen that there has been brought to the art a new and improved system and method for lubricating the normally contacting surfaces of a piston pin and connecting rod journal in an internal combustion engine. It is to be understood that the preceding description of the embodiments is merely illustrative of some of the many specific embodiments that represent applications of the principles of the present invention. Clearly, numerous and other arrangements would be evident to those skilled in the art without departing from the scope of the invention as defined by the following claims.

The invention claimed is:

1. A system for lubricating normally abutting bearing surfaces between a piston pin and a small end journal of a connecting rod of an internal combustion engine in which the piston pin and the small end journal together provide a rotatable connection between a piston and its corresponding connecting rod, the system comprising:

a source of lubricating oil being pumped under a first level of pressure;

communicating passages formed in a crankshaft and the connecting rod of the engine for delivering lubricating oil from the source to the abutting bearing surfaces;

an inertia pump installed within the connecting rod in communication with the communicating passages to provide a predetermined measure of lubricating oil between the abutting surfaces at a second pressure level that is higher than the first pressure level in reaction to the movement of the connecting rod wherein the pump has a first unbiased mass element which forces the predetermined measure of lubricating oil towards the pump outlet as the piston approaches bottom dead center portion of its stroke; and a second unbiased mass element which moves from a first position, that allows oil to flow at the first pressure level from the source and through the pump to the normally abutting surfaces, to a second position, blocking the oil flow from the source thereby allowing the predetermined measure of oil forced by the first unbiased mass element to flow from the pump outlet.

2. The system as in claim 1, wherein the first unbiased mass element has two portions: a first portion that slides within a first portion of the bore and contains several longitudinally formed passages to allow oil to flow therethrough when the plunger element moves within the bore; and a second portion that slides within a second portion of the bore to provide the injection of the predetermined measure of lubricating oil.

3. The system as in claim 2, wherein the second unbiased mass element moves from the second position to the first position in reaction to inertia forces acting upon the second unbiased mass as the piston approaches its top dead center position.

4. The system as in claim 2, wherein the second pressure level is sufficient to cause temporary separation between the normally abutting surfaces and to allow lubricating oil to be distributed therebetween.

5. The system as in claim 2, wherein the first unbiased mass element functions as an unbiased reciprocating plunger element within a bore that is oriented within the connecting rod to allow movement of the plunger along a longitudinal axis of the bore and such movement is an inertia reaction to acceleration and deceleration forces generated by the reciprocating movement of the piston during its stroke.

6. The system as in claim 2, wherein the second unbiased mass element functions, in conjunction with at least one opening in an oil passage in the pump, as a valve which remains open to allow oil to flow from the source through the oil passage and through the pump to the normally abutting surfaces over other portions of the stroke.

7. The system as in claim 2, wherein the second unbiased mass element moves from the first position to the second position in reaction to inertia forces caused by deceleration of the piston as it approaches bottom dead center.

8. The system as in claim 2, wherein the second pressure level is sufficient to cause temporary separation between the normally abutting surfaces and to allow lubricating oil to be distributed therebetween.

9. A method of lubricating normally contacting surfaces of a piston pin and a small end journal of a connecting rod of an internal combustion engine in which the piston pin and the small end journal together provide a connection between a piston and its corresponding connecting rod, the method comprising:

providing a source of lubricating oil at a first level of pressure;

providing a crankshaft and connecting rods of the engine with communicating passages for the delivery of lubricating oil from the source to the normally contacting surfaces;

providing a pump within a connecting rod to be in communication with the communicating passages to receive the lubricating oil from the source and to inject a predetermined measure of lubricating oil at a second pressure level that is higher than the first pressure level between the normally contacting surfaces as the piston reaches bottom dead center portion of its stroke wherein the pump is provided a first unbiased mass element that forces the predetermined measure of lubricating oil towards the pump outlet as the piston reaches bottom dead center portion of its stroke and a second unbiased mass which moves from a first position that allows oil to flow at the first pressure level from the source and through the pump to the normally abutting surfaces to a second position in which the oil flow from the source is blocked and only the predetermined measure of oil forced by the first unbiased mass element is allowed to flow from the pump outlet; the first unbiased mass element has a plunger mass portion and a plunger pump portion, the plunger mass portion has a greater diameter than the plunger pump portion, and the plunger mass portion has at least one longitudinal passage allowing flow of oil through the plunger mass portion.

10. The method of claim 9, wherein the first and second unbiased mass elements provided to be movable in directions parallel to the longitudinal inertia forces created in the connecting rod during the stroke.

11. The method of claim 9, wherein the second pressure level is sufficient to cause temporary separation between the normally contacting surfaces and to allow lubricating oil to be distributed therebetween.

12. The method of claim 11, wherein the first unbiased mass element is provided to function as an unbiased reciprocating plunger within a bore that is oriented within the connecting rod to allow movement of the plunger along its longitudinal axis within the bore and such movement is an inertia reaction to acceleration and deceleration forces generated by the reciprocating movement of the piston.

13. The method of claim 10, wherein the pump plunger portion of the first unbiased mass element injects the predetermined measure of lubricating oil through the outlet port.

14. The method of claim 13, wherein the second pressure level is sufficient to cause temporary separation between the normally contacting surfaces and to allow lubricating oil to be distributed therebetween.

15. An inertia reactive pump for receiving liquid from a source at a relatively low pressure and for providing a predetermined measure of liquid to a pump outlet comprising:

a plurality of freely movable mass elements which adapted to move in a plurality of longitudinal and axially-aligned bores within the pump in response to longitudinal inertia forces applied to the pump wherein:

a first of the freely movable mass elements is a first unbiased mass element that forces the predetermined measure of lubricating oil in a first direction towards the pump outlet in response to inertia force being applied to the pump in a second direction opposite to the first direction wherein the first unbiased mass element has several longitudinally formed passages along a portion of its length; and a second of the freely movable mass elements is a second unbiased mass which moves from a first position that allows oil to flow at the low pressure from the source through the pump to the pump outlet to a second position in which the oil flow from the source is blocked.

16. The inertia reactive pump of claim 15 wherein the first unbiased mass element has a plunger mass portion having a first diameter that moves within a first of the axially-aligned bores and a plunger pump portion having a second diameter that moves within a second of the axially-aligned bores; the first diameter is less than the first diameter; and the plunger mass portion has a plurality of longitudinal grooves to allow flow of oil through the grooves to thereby provide oil to the first of the axially-aligned bores.

* * * * *